US006594901B2

(12) United States Patent
David

(10) Patent No.: US 6,594,901 B2
(45) Date of Patent: Jul. 22, 2003

(54) METAL ORNAMENTATION TECHNIQUE

(76) Inventor: Zoltan David, 16827 S. Bridge La., Austin, TX (US) 78734

( * ) Notice: Subject to any disclaimer, the term of this patent is extended or adjusted under 35 U.S.C. 154(b) by 0 days.

(21) Appl. No.: 09/934,267

(22) Filed: Aug. 21, 2001

(65) Prior Publication Data

US 2002/0023348 A1 Feb. 28, 2002

Related U.S. Application Data

(60) Provisional application No. 60/227,086, filed on Aug. 22, 2000.

(51) Int. Cl.[7] ..... A44C 27/00

(52) U.S. Cl. ..... 29/896.412; 29/896.4; 29/896.41; 29/527.6; 63/3; 63/15; 63/15.7; 63/15.8; 63/26; 63/38

(58) Field of Search ..... 29/896.41, 896.411, 29/896.412, 896.4, 527.6; 23/3, 15, 15.7, 15.8, 23, 34, 26, 29.1, 38

(56) References Cited

U.S. PATENT DOCUMENTS 375,526 A * 12/1887 Angell
958,641 A * 5/1910 Heeren
2,140,396 A * 12/1938 Whitaker
2,458,645 A * 1/1949 Rosenberg et al.
2,653,402 A * 9/1953 Bonagura
2,747,259 A * 5/1956 Brioux
4,195,493 A * 4/1980 Bogner et al.

OTHER PUBLICATIONS

Choate, Sharr and De May, Bonnie Cecil, "Creative Gold and silver Smithig", Crown Publishers, Inc., New York, 1970, pp. 139–150.*

* cited by examiner

*Primary Examiner*—P. W. Echols
(74) *Attorney, Agent, or Firm*—Vinson & Elkins L.L.P.

(57) ABSTRACT

The present invention discloses novel methods for producing raised and sculpted ornamentation or designs on metal, including metal pieces such as jewelry. Also disclosed are pieces of metal, including jewelry, produced by using the disclosed methods.

21 Claims, 2 Drawing Sheets

(1 of 2 Drawing Sheet(s) Filed in Color)

METAL ORNAMENTATION TECHNIQUE

This application claims benefit of U.S. provisional patent application No. 60/227,084, filed Aug. 22, 2000.

BACKGROUND OF THE INVENTION

1. Field of the Invention

The present invention pertains to methods of ornamenting or decorating a metal surface in order to create a pattern of contrasting metal. The present invention also relates to metal objects ornamented by the technique described. The invention particularly relates to the ornamentation of jewelry by applying beads or other forms of precious metal to a precious-metal-jewelry surface.

2. Description of Related Art

No known method exists to create a decorated or ornamented piece of metal, such as jewelry, in which the ornamentation has the unique look resulting from a raised or three-dimensional sculpted pattern, and also is resistant to wear or erosion. For example, known methods of decorating or ornamenting metal surfaces, and in particular, methods for creating patterns or ornamenting jewelry, to create a design that has a smooth surface or an indented surface, are known. Such methods include inlaying metal, resulting in patterns or ornamentation that has a surface flush or even with the surface of the receiving metal, as well as methods of cutting or carving patterns into a metal surface, resulting in pieces of metal that have indentations. Such traditional methods are unable to produce a sculpted or shaped three-dimensional design or ornamentation. Alternatively, methods of coating a metal to create a pattern, such as by electroplating or painting the metal are well-known, but are deficient in that the design lacks both durability, as the coating tends to wear away with age and use of the piece, as well as a three-dimensional or raised sculpted appearance. Thus, there remains a need in the art for a method of producing a metal piece, such as jewelry, that is decorated with a durable three-dimensional or raised design or ornamentation.

BRIEF SUMMARY OF THE INVENTION

The present invention teaches a method for producing ornamented or decorated metal pieces, where the ornamentation is raised or three-dimensional, and sculpted or beaded, and is durable to withstand wear or use of the metal piece. In certain embodiments the metal piece decorated by the presently-disclosed methods is a piece of jewelry.

The present invention includes a method of ornamenting a metal surface including the following steps: (a) obtaining an object comprising an accepting metal having a metal surface; (b) creating one or more holes or negative spaces within the accepting metal or metal surface; and (c) filling said holes or negative spaces with a second metal. Optionally, the method further includes the step of shaping the second metal into one or more beads projecting from the metal surface.

The present invention also includes a method of ornamenting a metal surface including the following steps: (a) obtaining an object comprising an accepting metal having a metal surface; (b) marking the metal surface with a desired pattern; (c) creating one or more holes or negative spaces within the metal surface where the metal surface has been marked; and (d) filling said holes or negative spaces with a second metal. Optionally, this method further includes shaping the second metal into one or more domes or other distinct shape projecting from the metal surface.

The metal surface or accepting metal can be any metal, including any precious metal. Precious metals are known to those of skill in the art and include, for example, metals such as gold, silver, iridium, ruthinium, paladium, and platinum. The metal used may be the pure metal or an alloy containing one or more metals.

The second metal which is used to create the beads on the first metal surface may also be a precious metal. The second metal may also be the pure metal or an alloy including one or more metals. The second metal can be the same type of metal as the metal surface or accepting metal, or can be a different type of metal.

A further feature of the invention is the use of a second metal that is a different color than the metal surface used in order to create a pattern of contrasting-color beads on the metal surface. Further, the individual beads imbedded into the metal surface may be all the same color, or may be different colors.

Using the method of the present invention, the holes or negative spaces in the metal surface or accepting metal can be created by drilling a hole in the accepting metal, or by any other means of creating a hole or negative space in a metal surface that is known to those of skill in the art. The negative spaces can also be channels or indentations of any shape that are carved into the accepting metal. In certain embodiments, holes or channels of up to 1 mm or to 2 mm in depth are drilled or carved into the accepting metal. The holes or negative spaces created in the accepting metal can penetrate the entire thickness of the accepting metal or they can only go through a portion of the accepting metal.

The holes or negative spaces created in the accepting metal can be filled with the second metal by any means available to those of skill of the art. In certain embodiments, the holes or spaces are filled by melting the second metal, so that it flows to fill the holes or spaces. In alternate embodiments, the second metal can be hammered into the holes or negative spaces in the accepting metal.

After the holes or negative spaces in the accepting metal have been filled with the second metal, the second metal is shaped using a beading tool, millgrain tool, or other suitable instrument, to create a bead or series of beads or other shapes of metal projecting from the metal surface. The metal can be shaped as desired and may even include further ornamentation on the shapes. In certain embodiments, the second metal is shaped into a dome or half sphere projecting from the metal surface, where the edge of the dome is even or flush with the metal surface.

In one embodiment, the dome or half-sphere shape is formed on the metal surface by using a steel punch with a concave point. In such embodiments, the concave point of the steel punch should be approximately the same diameter as the hole or negative space created in the accepting metal. In an alternative embodiment, when the negative space is a channel, a millgrain tool is used to shaped the metal into a series of beads, domes, or half-spheres along the channel.

When using the method that includes marking the accepting metal, a mark or series of marks, such as circular marks, are made on the metal surface in a desired pattern or design. Individual holes or negative spaces in the metal surface are then created by producing a hole in the accepting metal at the places indicated by the mark or series of marks. The holes, channels, or negative spaces can be produced by drilling or by any other means known to those of skill in the art. In certain embodiments, holes or channels of up to 1 mm or to 2 mm in depth are drilled into the accepting metal. The holes, channels, or negative spaces created in the accepting metal can penetrate the entire thickness of the accepting metal or can be made a depth which does not penetrate the entire thickness of the accepting metal.

The present invention is also directed to metal objects that have been decorated or ornamented using the described techniques. In particular, the present invention is directed to pieces of jewelry produced using the described techniques. In certain embodiments the jewelry of the present invention will have a metal surface composed of a precious metal or precious metal alloy. In other embodiments, the inlayed metal forming the beaded design on the metal surface will also be composed of a precious metal or precious metal alloy.

Additional embodiments within the scope of the present invention include those in which the disclosed methods are used to produce ornamentation in combination with other ornamentation, such as the setting of gems.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

The following drawings form part of the present specification and are included to further demonstrate certain aspects of the present invention. The invention may be better understood by reference to one or more of these drawings in combination with the detailed description of specific embodiments presented herein.

DETAILED DESCRIPTION OF THE INVENTION

Figure 1:
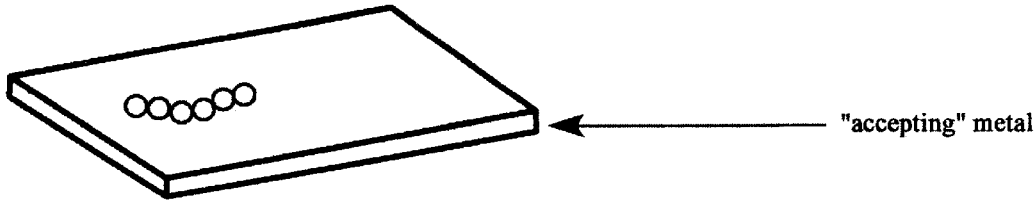
FIG. 1. The metal surface of an accepting metal that has been pre-marked with a desired pattern.
Figure 2:
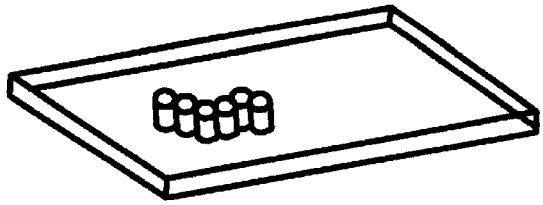
FIG. 2. Individual holes or negative spaces are produced in the accepting metal. The surface of the accepting metal may have been previously marked as in FIG. 1, or the holes may be produced without prior marking of the metal surface. In the embodiment depicted in the figure, holes are not drilled through the entire thickness of the accepting metal.
Figure 3:
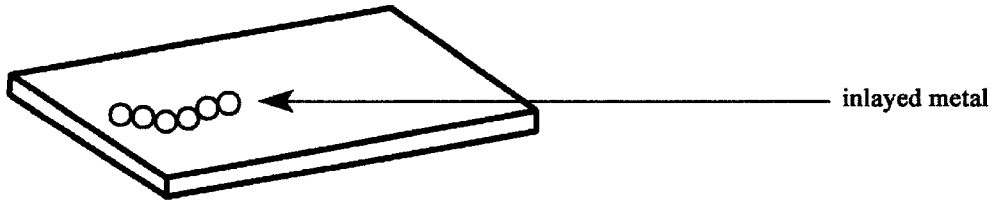
FIG. 3. The holes produced are inlayed with a second metal. In the embodiment depicted, the second metal is a metal of a contrasting color relative to the metal surface.

The present invention is a method of decorating a metal surface or an ornamentation method to create individual beads or a series of beads or other sculpted shapes of metal on a metal surface. The method of the present invention is particularly useful in the creation of metal jewelry having an ornamented surface design. In particular, the present invention is directed to the creation of precious metal jewelry. Using the present technique, raised beads or shapes of inlayed metal are produced on the surface of a metal object. The beaded design can be further emphasized by having one type of metal used for the metal surface and a different type of metal, particularly one of a contrasting color, used to create the beaded inlay. For example, by inlaying a platinum surface with gold to create individual gold beads imbedded into a platinum surface, or inlaying a gold surface with platinum to create individual platinum beads imbedded into a gold surface, a pattern of contrasting-colored beads can be produced on a metal surface. Any combination of metals can be used for the metal surface and bead inlays, and the metal surface and/or bead inlays can themselves be composed of more than one type of metal.

The metal object to be ornamented should include an accepting metal having a metal surface. The accepting metal can be composed of any appropriate metal, including, for example, a precious metal or precious metal alloy. Alternatively, for example, the accepting metal can be a non-precious metal having a metal surface composed of a precious metal or precious metal alloy.

The metal piece being decorated or ornamented is, in certain embodiments, a piece of jewelry. The jewelry can be an earring or pair or earrings, a ring, bracelet, pendant or brooch, a charm for a bracelet or necklace, a necklace itself, a watch, cufflinks, belt buckle, or the like. The jewelry can be decorated by the presently disclosed methods using any metal, metal alloys or combination thereof, including precious metals or alloys. For example, metals and alloys that can be used include, without limitation, gold (including 24, 22 18 or 14 carat gold), silver, iridium, ruthidium, paladium, and platinum (including platinum 1000 and platinum 950).

As an aid to the practitioner, the surface of the metal object to be ornamented can be initially marked to indicate the desired design pattern. Such marks then serve as a guide for where the holes, channels, or negative spaces in the accepting metal will be created to receive the inlayed metal. In certain embodiments, circular marks are inscribed on the metal surface, and can denote the outer edge of the domed beads that will be created.

Holes, channels, or negative spaces are created in the accepting metal by any method that produces an indentation of any shape (square, triangle, star, or other) in the accepting metal. One method of creating these holes, channels, or negative spaces is to drill them or carve them. If marks have been made in the metal surface, these can be used as a guide for drilling the holes or channels, or the negative spaces can be produced free-hand. In certain embodiments, holes of up to 1 mm or up to 2 mm are created in the accepting metal. The holes, channels, or negative spaces that are created can penetrate the entire thickness of the accepting metal, or they can be of a depth less than the entire thickness of the accepting metal.

Once the holes, channels, or negative spaces are produced they are inlayed with the second metal. Methods for filling the holes, channels, or negative spaces with the second metal include melting the metal into the holes, and hammering the metal in.

Once the metal to be inlayed has been inserted into the holes or negative spaces in the accepting metal, the inlayed metal is shaped. Any desired shape can be produced by any useful method. For example, to create a dome or half-spherical shaped bead a beading tool consisting of a steel punch with a concave point or a millgrain tool can be used. In such a case, the concave tip of the beading tool or millgrain tool can be approximately the same diameter as the hole, or width of the channel, in which the metal inlay has been inserted, and thereby is used to create a bead whose edge is even with the receiving metal surface. The shape of the resulting dome will be determined by the curvature of the concave point of the steel punch or millgrain tool. The dome may approximate a half-sphere shape, or may be a more flattened or elongated dome, as determined by the shape of the beading tool or millgrain tool used. Alternative bead or other shapes that can be produced will be readily apparent to those of skill in the art.

The following examples are included to demonstrate preferred embodiments of the invention. It should be appreciated by those of skill in the art that the techniques disclosed in the examples which follow represent techniques discovered by the inventor to function well in the practice of the invention. However, those of skill in the art should, in light of the present disclosure, appreciate that many changes can be made in the specific embodiments which are disclosed and still obtain a like or similar result without departing from the spirit and scope of the invention.

EXAMPLE 1

Figure 4:
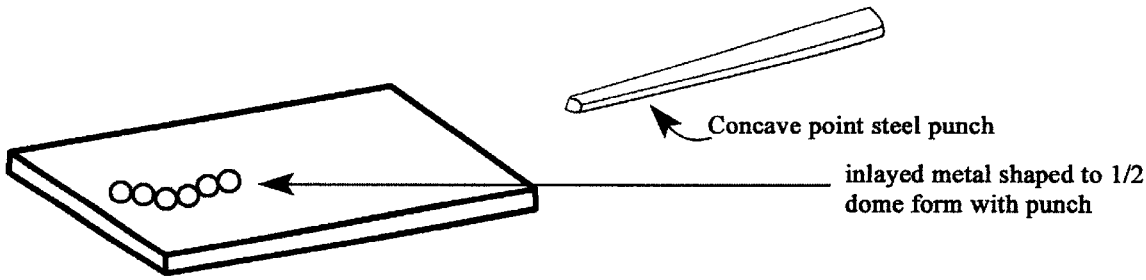
FIG. 4. A beading tool, in this instance a steel punch with a concave point, is pressed into the inlayed metal to create a domed bead of inlayed metal permanently affixed to the accepting metal.
Figure 5:
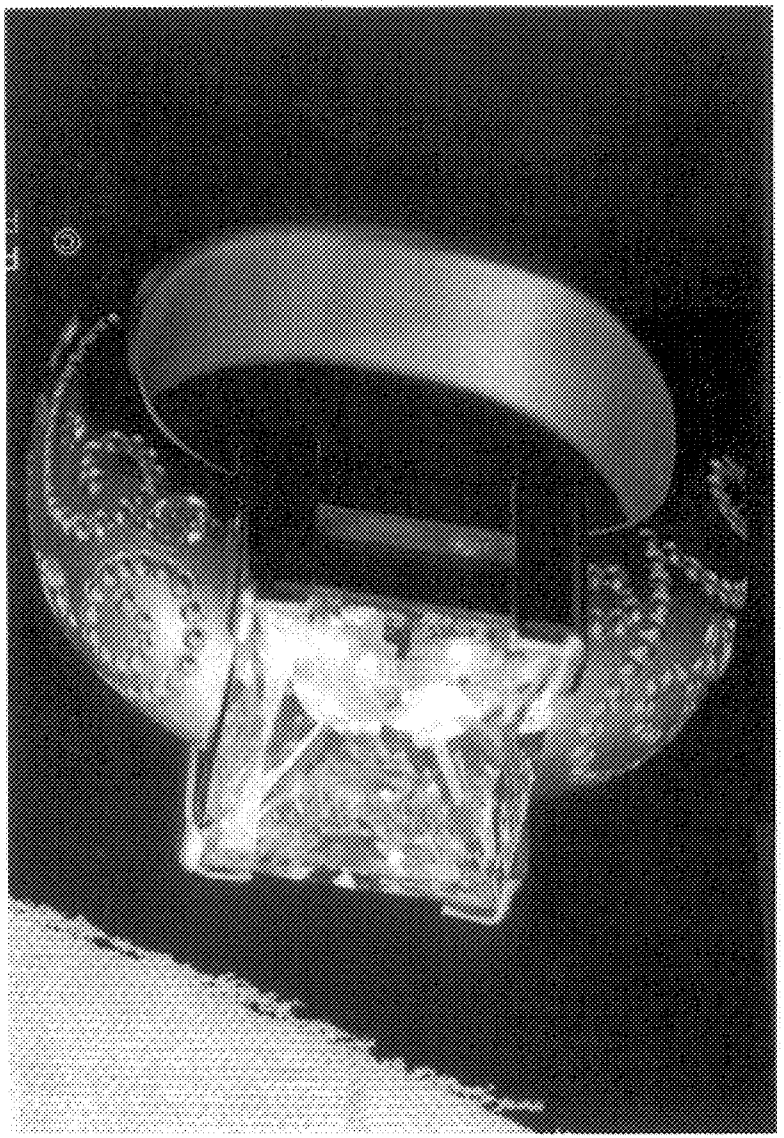
FIG. 5. A photograph of a piece of finished jewelry created using the technique of the present invention.

Earrings. Earring were made by using 22 carat gold as the receiving metal. Circular indentations of about 1 mm in depth were made in the 22 carat gold receiving metal using a drill. Platinum was put into the holes, and then melted to fill the hole evenly, with the platinum extending above the surface of the receiving metal, and extending to the edges of the holes drilled in the receiving 22 carat gold. The platinum was shaped into beads using a beading tool having a steel punch with a concave point (see FIG. 4).

EXAMPLE 2

Ring. Ring was shaped using platinum 950 as receiving metal. 1 mm deep holes were drilled in harlequin-type pattern along ring. Holes were filled with platinum 1000, which was then melted to fill the holes evenly, with the platinum 1000 extending above the surface of the receiving metal, and extending to the edges of the holes drilled in the platinum 950 receiving metal. The platinum 1000 was shaped into beads using a beading tool having a steel punch with a concave point. Sapphires were set in the platinum 950 between the beading patterns along the ring, and a single diamond was placed at the apex of the ring, also between the beading pattern.

All of the compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the methods described herein without departing from the concept, spirit and scope of the invention. More specifically, it will be apparent that certain agents that are chemically or physiologically related can be substituted for the agents described herein while the same or similar results would be achieved. All such similar substitutes and modifications apparent to those skilled in the art are deemed to be within the spirit, scope and concept of the invention as defined by the appended claims.

What is claimed is:

1. A method of ornamenting a metal surface comprising:

(a) obtaining an object comprising an accepting metal having a metal surface;

(b) creating one or more holes, channels, or other negative spaces having boundary edges, within the accepting metal surface;

(c) filling said holes, channels, or other negative spaces with a second metal; and then (d) shaping only the second metal with an instrument into one or more distinct raised shapes within the boundary edges of the holes, channels or other negative spaces.

2. The method of claim 1, wherein the second metal is shaped into one or more beads.

3. The method of claim 2 wherein the instrument is a beading tool or a millgrain tool.

4. The method of claim 3 wherein the beading tool is a steel punch with a concave point.

5. The method of claim 2 wherein the beads are domes or half spheres.

6. The method of claim 1 wherein the metal surface comprises a precious metal.

7. The method of claim 6 wherein the second metal comprises a precious metal.

8. The method of claim 1 wherein the second metal is a different color metal than the metal surface.

9. The method of claim 1 wherein said holes, channels or negative spaces are filled with a second metal by melting the second metal into the holes, channels or negative spaces.

10. The method of claim 1 wherein said holes, channels or negative spaces are filled with a second metal by hammering the second metal into the holes, channels or negative spaces.

11. The method of claim 1 wherein the one or more distinct raised shapes extend above the surface of the accepting metal.

12. A method of ornamenting a metal surface comprising:

(a) obtaining an object comprising an accepting metal having a metal surface;

(b) marking the metal surface with a desired decorative pattern;

(c) creating one or more holes, channels, or negative spaces having boundary edges, within the metal surface where the metal surface has been marked;

(d) filling said hoses, channels or negative spaces with a second metal; and then (e) shaping the second metal with an instrument into one or more distinct raised shapes within the boundary edges of the holes, channels or other negative spaces.

13. The method of claim 12, wherein the second metal is shaped into one or more domes or beads.

14. The method of claim 13 wherein the instrument is a beading tool or millgrain tool.

15. The method of claim 14 wherein the beading tool is a steel punch with a concave point.

16. The method of claim 12 wherein the metal surface comprises a precious metal.

17. The method of claim 12 wherein the second metal comprises a precious metal.

18. The method of claim 12 wherein the second metal is a different color metal than the metal surface.

19. The method of claim 12 wherein the holes, channels or negative spaces are filled with a second metal by melting the second metal into the holes or negative spaces.

20. The method of claim 12 wherein the holes, channels or negative spaces are filled with a second metal by hammering the second metal into the holes or negative spaces.

21. The method of claim 12 wherein the one or more distinct raised shapes extend above the surface of the accepting metal.

* * * * *